United States Patent [19]

Fuss, III

[11] 3,999,184

[45] Dec. 21, 1976

[54] SATELLITE TRACKING ANTENNA APPARATUS

[75] Inventor: LeRoy Fuss, III, Roswell, Ga.

[73] Assignee: Scientific-Atlanta, Inc., Atlanta, Ga.

[22] Filed: July 23, 1975

[21] Appl. No.: 598,457

[52] U.S. Cl. ..... 343/709; 343/765

[51] Int. Cl.[2] ..... H01Q 3/08

[58] Field of Search ..... 343/709, 763, 764, 765, 343/766

[56] References Cited

UNITED STATES PATENTS 2,740,962 4/1956 Hammond ..... 343/766

*Primary Examiner*—Eli Lieberman

*Attorney, Agent, or Firm*—Martin Lukacher

[57] ABSTRACT

A satellite tracking antenna structure is disclosed which is adapted to be mounted at the head of the mast of a ship. The antenna itself, is provided with a reflector which forms one side of a box structure, which is open on the side thereof opposite to the reflector and has a rigidifying structure including an arched beam mounted in the box between the reflector and the open side of the box opposite to the reflector. Located within the box structure is a pedestal extending upwardly from the mast. A stable platform arrangement is mounted on the pedestal and the box structure is pivotly mounted on the stable platform arrangement so as to enable the antenna to be rotated in azimuth and in elevation in the direction of a satellite with which communication is desired.

14 Claims, 7 Drawing Figures

SATELLITE TRACKING ANTENNA APPARATUS

The present invention relates to antenna apparatus and particularly to satellite tracking antenna apparatus.

The invention is especially suitable for use in a shipborne satellite communication terminal wherein the antenna is operated to track a transmitting station carried by a satellite in spite of the roll, pitch and turn motions associated with a ship at sea.

A maritime communications satellite terminal is designed to provide ship-to-shore communications via a satellite. Inasmuch as voyages may be of prolonged duration the satellite terminal of necessity must be easily maintainable and be reliable in operation. The satellite antenna is constrained by the nature of the transmissions which the satellite is designed to handle to be a highly directive antenna. Such antennas require reflectors of relatively large size, say of four foot diameter. It is therefore necessary to point the antenna (viz. the axis of the reflector) toward the statellite to a high degree of accuracy. The ship moves under the satellite as it travels across the sea. In addition, the ship rolls, pitches and turns. Rolling and pitching in a heavy sea, of course, as well as turning of the ship to different headings, whether advertently or due to heavy seas, changes the orientation of the antenna. In addition, the motions of the ship are translated and applied to the antenna with considerable force.

It is desirable and in many cases necessary, to mount the antenna structure at the highest practicable point on the ship. This is done in order to minimize the effect of reflections of signals from the ship's super structure and from the sea surface which could cause perturbations in the signals received from the satellite by the antenna. Mounting at the highest practical point on the ship also is desirable since it reduces interruption of the received or transmitted signals by blocking of the signal path at parts of the ship, as during rolling, pitching or turns, or by hills, mountains or buildings in waters close to shore. To this end, it is desirable to mount the antenna structure at the head or top of the mast on the ship. At such locations, the forces applied to the antenna structure due to the rolling, pitching and turning motion of the ship are amplified. In addition, ships carry a large amount of machinery, such as the ship's engines, cranks, winches and the like, which generate high amplitudes of vibration. The antenna structure is therefore prone to such vibration and must operate reliably in spite of high vibration amplitudes.

Although satellite tracking systems have been proposed, these, for the most part have been for land based use, where a structure of considerable size and weight can be accommodated (see U.S. Pat. Nos. 3,141,168 and 3,714,660). In addition, there is no need in land based satellite tracking antenna arrangements to stabilize the antenna for rolling, pitching and turning motions as is the case for a maritime satellite antenna. Stabilizing arrangements for shipborne antenna systems have also been proposed (see U.S. Pat. Nos. 3,358,285 and 3,860,931). However, an antenna structure capable of accommodating stabilizing arrangements and yet being adapted for the severe environment of aboard ship without aggravating the problem of maintaining the antenna directed and pointed to the satellite in spite of ship motion, vibration and mounting location constraint, has not been available prior to the present invention.

Accordingly, it is the principal object of the present invention to provide an improved satellite tracking and antenna apparatus wherein the foregoing difficulties and disadvantages are substantially eliminated.

It is the further object of the present invention to provide an improved shipboard antenna structure for use in a system for tracking a satellite in spite of motion of a ship at sea.

It is a still further object of the present invention to provide an improved maritime satellite tracking antenna apparatus which is reliable in operation, easily maintained, uncomplicated and readily fabricated.

It is a still further object of the present invention to provide an improved tracking antenna apparatus which is capable of rotational or tilting motion about a plurality of axes without large driving forces to rotate or tilt the antenna.

It is a still further object of the present invention to provide an improved tracking antenna apparatus which utilizes a relatively large antenna assembly, such as a large reflector dish, and nevertheless requires a minimum of counterbalancing weights.

It is a still further object of the present invention to provide an improved maritime tracking antenna apparatus capable of accommodating shock and vibration.

It is a still further object of the present invention to provide an improved maritime satellite tracking antenna apparatus which is substantially rigid and strong so as to be capable of withstanding moments, pressures, vibration, shock, and other forces when disposed in operational relationship with a ship at sea, as on the mast of the ship, and yet is light in weight.

Briefly described, the satellite tracking antenna apparatus embodying the invention is mounted on a pedestal which can extend upwardly from the top of the mast of the ship. A yoke on the upper end of the pedestal carries a platform which, through the use of a suitable servo mechanism responsive to sensors mounted on the platform, stabilizes the platform for pitch and roll motion of the ship.

A turntable is mounted on the platform and is rotatable in azimuth about an axis which may be co-incident with axis of the pedestal when the pedestal is vertical. The turntable also has journals which define an elevation axis perpendicular to the azimuth axis. A box-shaped structure having rectangular sides is mounted on the turntable and encloses the upper end of the pedestal, the platform and the turntable. The sides of the box-shaped structure are each mounted on a different one of the turntable journals, so that the box-shaped structure may be rotated or tilted in elevation as well as rotated in azimuth. The forward end of the box structure is formed by the reflector of the antenna which receives signals from the satellite and may transmit signals thereto. The side members extend in a direction away from the reflector beyond the elevation axis and preferably past the pedestal, leaving the rear end of the box structure open. An unenclosed and unobstructed area is defined in the box structure behind the pedestal so that there is clearance for rotation of the antenna in elevation, in spite of rotation of the turntable and the stable platform. Notwithstanding such clearance, the box structure is made rigid and strong so as to accommodate the forces, shock and vibrations and other moments to which it may be exposed in the severe environment aboard ship. To this end, an arched beam structure is disposed between the side members for bracing the structure without interfering with the open area. This arched beam structure may be fabricated from thin plates or sheet-like members disposed in a plane perpendicular to the side members and immediately behind (viz, toward the open rear end). In addition, braces in the form of struts, may be disposed between the side members and the rear of the reflector in the region of the box structure between the reflector and the arched beam structure. An antenna supporting structure is therefore provided which is well adapted for maritime use and nevertheless is light in weight and requires minimum counter-balancing and nevertheless is capable of accommodating shock, vibration and other forces which may be encountered on a ship at sea.

The foregoing and other objects and advantages of the present invention will become more apparent from the reading of the following description of the preferred embodiment of the invention which is set forth hereinafter and is shown in the accompanying drawings in which.

Figure 1:
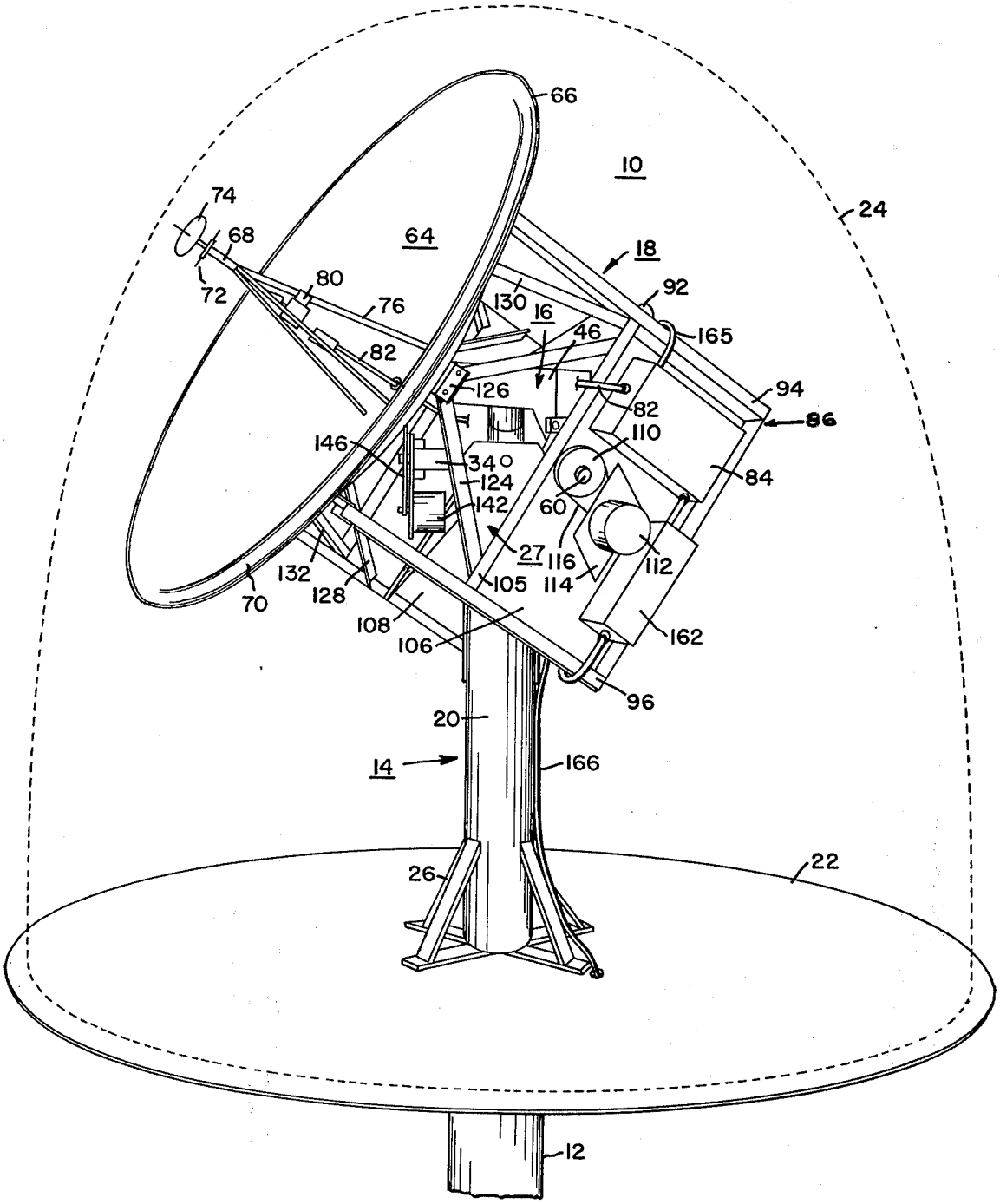
FIG. 1 is a perspective view of a maritime satellite tracking apparatus embodying the invention.

Referring more particularly to FIGS. 1 to 7, there is shown a satellite tracking antenna 10 adapted to be mounted on the top of a mast 12 of a vessel having a satellite communication terminal. This terminal contains equipment for controlling the antenna so that it remains pointed in the direction of the satellite and also for transmitting and receiving messages so as to provide ship-to-ship or ship-to-shore communications via the satellite. The apparatus for pointing the antenna toward the satellite and maintaining the antenna pointed towards the satellite is the subject matter of a related application filed concurrently with this application in the name of Joseph Graham Mobley, Ser. No. 598,492, and assigned to the same assignee as this application.

The principal parts of the antenna apparatus are its pedestal arrangement 14, a stable platform arrangement 16 and an antenna structure 18. The stable platform arrangement 16 is generally shown in FIG. 7.

The pedestal arrangement 14 consists of a cylindrical post 20 disposed on a circular base 22. A redome 24 illustrated by the dash lines encloses the entire antenna apparatus and is secured to the base 22. An arrangement of legs and crossbars 26 which may be welded to the post 20 and bolted to the base, supports the post on the base. An arrangement of bolts extending from the bar arrangement 26 through the base 22 secures, through suitable brackets, the base and post to the head of the mast 12.

A U-shaped yoke 27 having side members 28 and 30 in the form of channels (see FIGS. 3 and 7) is secured to the upper end of the post 20. A shaft 32 journaled in these side members 28 and 30 defines the roll axis 40 of the stable platform 16.

Figure 2:
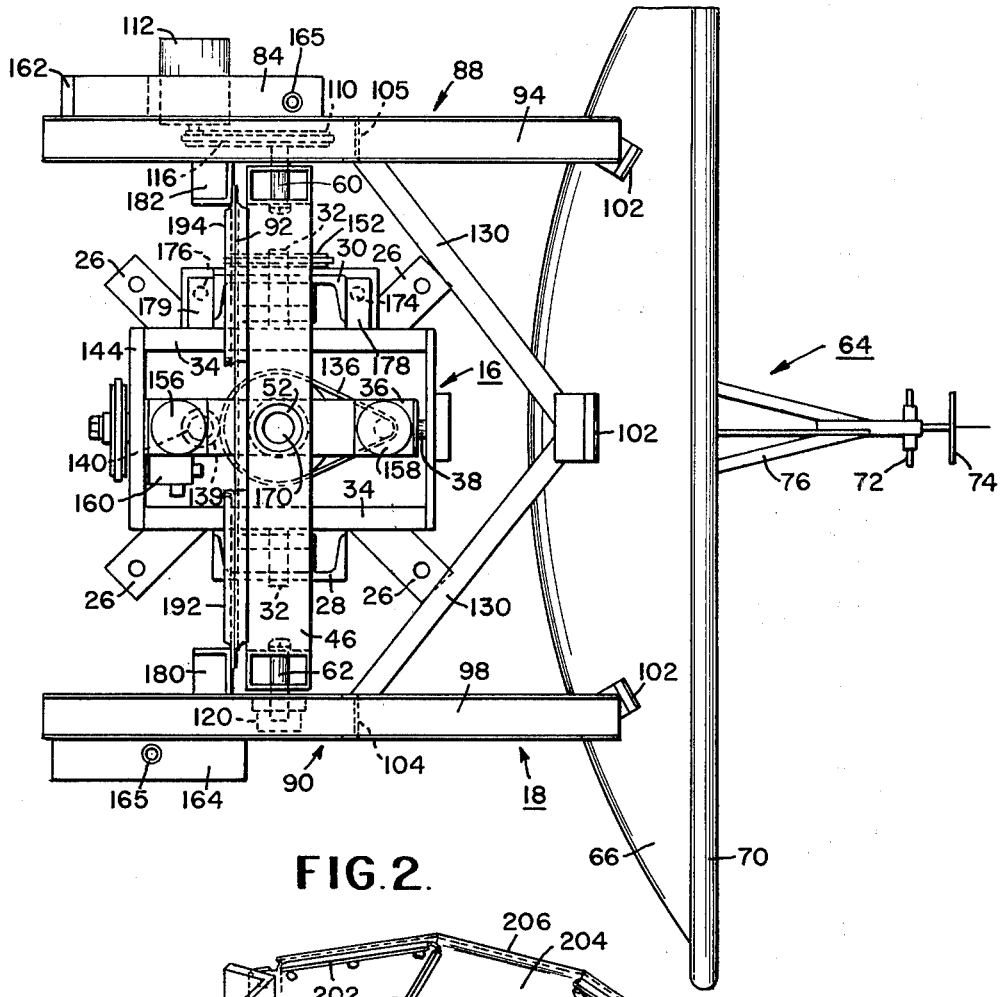
FIG. 2 is a top view of the antenna apparatus shown in FIG. 1.
Figure 7:
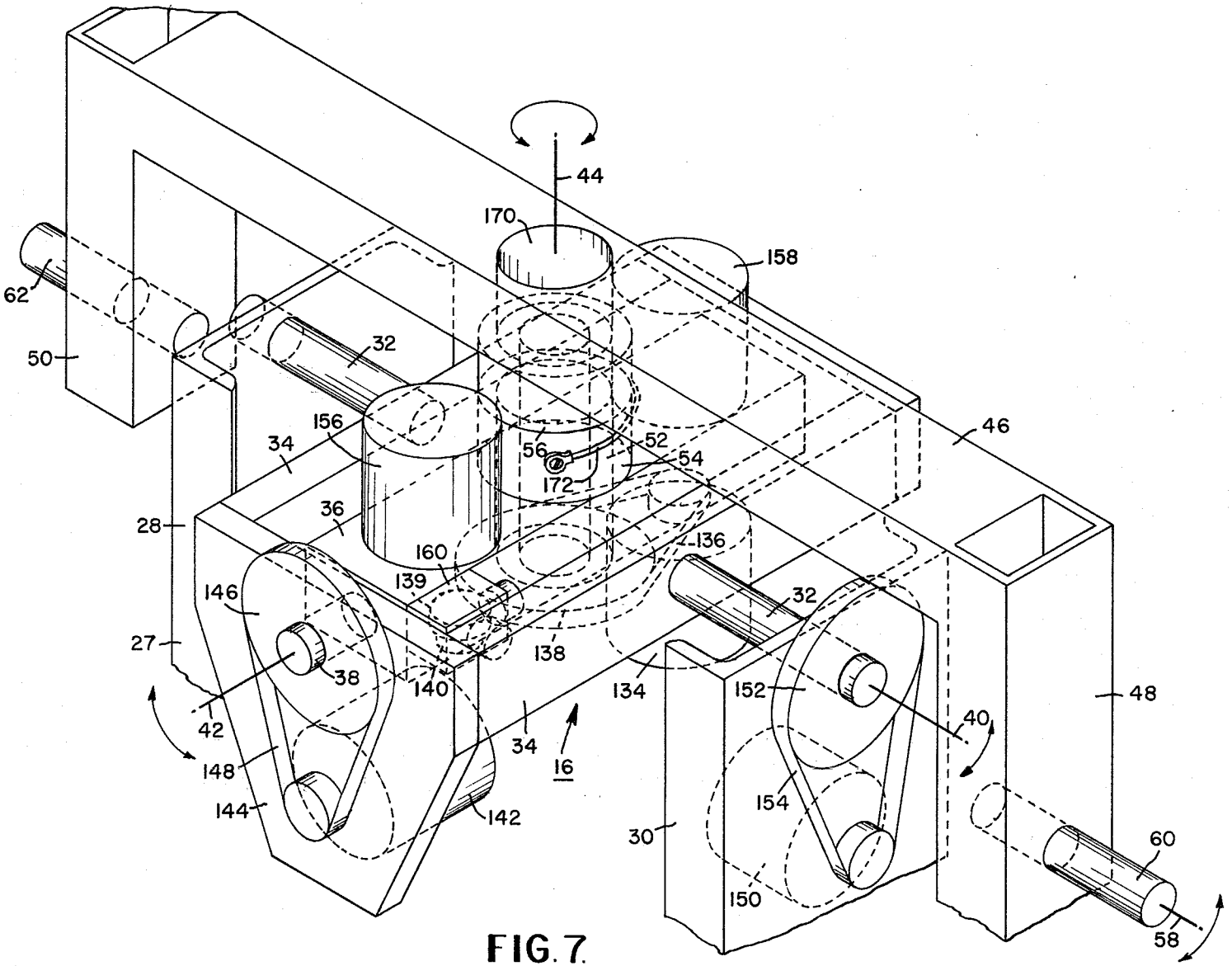
FIG. 7 is a simplified perspective view of the stable platform and associated apparatus which forms part of the antenna apparatus illustrated in FIG. 1 – 5.

The stable platform 16 is made up of a frame 34, the opposite sides of which are attached to the shaft 32 (see FIGS. 2 and 7). The stable platform 36 is pivotly mounted within the frame 34 on the shaft 38. The shaft 38 is journaled in the side members of the frame 34 and is attached to the platform 36. The pitch axis 42 of the platform is defined by the axis of the shaft 38. The roll axis 40, pitch axis 42 and the azimuth axis 44, which extends downwardly to the center of the stable platform, are all perpendicular to each other and intersect at a common point. The pitch and roll axes 40 and 42 lie in the same plane. A turntable 46 is mounted on the platform 36 for rotation about the azimuth axis 44. The turntable 46 is a U-shaped member having downwardly depending arms 48 and 50. The center of the turntable is driven by a shaft 52 which extends through a bearing cylinder 54 mounted on the platform 36. The shaft 52 extends from a cylinder 56 of approximately the same diameter of the cylinder 54. The shaft 52 is pivotally mounted in bearings inside the cylinder 54, which bearings support the turntable 46. The elevation axis 58 is defined by shafts 60 and 62 which extend laterally from the arms 48 and 50 of the turntable 46. The axis of these shafts is the elevation axis 58. The elevation axis 58 is perpendicular to the azimuth axis and is approximately co-incident, or slightly below the roll axis.

The terms pitch and roll are used arbitrarily so as to simplify the description. It will be appreciated that the pitch axis will become the roll axis and vice versa if the post 20 and yoke 26 of the pedestal arrangement is turned 90 degrees about the azimuth axis 44.

The antenna structure 18 is pivotly mounted on the shafts 60 and 62 for rotation about the elevation axis 58. The entire antenna structure 18 is supported by the turntable 46 at the shafts 60 and 62. The antenna structure 18 consists of an antenna 64 made up of a parabolic reflector dish 66 and a feed 68. The dish 66 is preferably spun from perforated thin gauge aluminum and has a rolled edge 70 to provide mechanical stiffness. The feed 68 is made up of crossed dipoles 72 behind a reflector disc 74. The feed is mounted on an arrangement of rods 76 which form a tripod. The outputs of the feed may be combined in a hybrid 80 which is connected to a cable 82 extending through the center of the dish 66. The cable is connected to a diplexer 84 which is mounted on the antenna structure 18.

The reflector dish 66 forms one end of a box structure 86. The remainder of this box structure 86 consists of side members 88 and 90 and an arched beam structure 92 which, in accordance with a important feature of the invention, provides mechanical stiffness and rigidity without increasing weight of the antenna structure 18. The arched beam structure 92 also affords an open space behind the turntable 46 so as to permit the antenna structure 18 to rotate at least ninety degrees in elevation. The axis of the antenna can be pointed vertically and horizontally, as well as any elevation between the vertical and horizontal (see FIG. 4). The side members are formed of channel members 94 and 96 on the left side member and channel members 98 and 100 on the right side member. These channels 94, 96, 98 and 100 as well as other struts and braces described hereinafter are attached by brackets 102 to the rear of the reflector dish 66. Separate channels 104 and 105 extend laterally between the channels 94 and 96 of the left side member 88 and also between the channel members 98 and 100 of the right side members. These lateral channels 104 and 105 are disposed opposite to each other and form a frame in which plates 106 and 108 are provided towards the rear of the left and right side members 88 and 90 respectively. The elevation axis shafts 60 and 62 extend through journals in the plates 106 and 108.

The antenna structure 18 is bodily rotatable about these shafts. To this end a pulley 110 is fixedly mounted as by being keyed to the shaft 60. An electric motor which is operative as the elevation servo motor 112 is mounted on a bracket plate 114 located on the plate 106. The shaft of the elevation motor 112 drives a timing belt 116 which is trained around the pulley 110. The pulley 110, belt 116 and motor drive pulley are preferably toothed. The elevation motor 112 moves in a planetary fashion about the pulley 110. Consequently the entire antenna structure 18 moves bodily about the elevation axis shafts 60 and 62. A potentiometer 120 (see FIG. 5) is mounted on a bracket 122 attached to the plate 108 of the right side arm 90. The shaft of the potentiometer 120 is attached to the elevation axis shaft 62. The resistance presented by the potentiometer 120 is therefore a function of the rotation of the antenna 64 about the elevation axis.

Additional rigidity is imparted to the box structure 86 by struts which may be angle members and which form triangular braces 124 in the left side member. These struts are connected at their apex by way of a bracket 126 to the rear of the reflector dish 66. These braces are made out of angle members. Similar braces 128 are provided in the right side member. Triangular braces 130 and 132 are provided in the box structure 86 between the upper channel members 94 and 98 and lower channel members 96 and 100 of the left and right side members respectively. These upper and lower triangular braces extend forwardly to the rear of the reflector dish 66 from positions immediately forward of the lateral channel members 104 and 105 (see FIG. 2).

As shown in FIGS. 2 and 7, the azimuth shaft 52 is rotated by an azimuth servo motor 134 which drives a toothed timing belt 136. A pulley 138 which is also toothed is driven by the belt 136. The pulley 138 is keyed to the azimuth shaft 52. The aximuth motor is secured, as by being mounted on a bracket, on the underside of the platform 36. The outer periphery of the timing belt 136 as well as the inner periphery thereof may be toothed and used to drive the shaft 139 of a potentiometer 140, also mounted on the underside of the platform 36. The resistance presented by the azimuth potentiometer 140 corresponds to the angular position of the antenna 64 in azimuth.

The stable platform 36 is oriented by a pitch motor 142 mounted on a side 144 of the frame 34 (see FIGS. 2 and 7). The pitch shaft 38 is keyed to a pulley 146 which is driven by the pitch motor 142 referably via toothed, timing belt 148. The stable platform 36 together with the frame 34 is rotated about the roll axis 40 by a roll servo motor 150 which is mounted on the arm 30 of the yoke which extends upwardly from the post 20. A pulley 152 keyed to the roll shaft 32 is driven by a timing belt 154. The shaft or a drive pulley on the shaft of the roll motor 150, the belt 154 and the periphery of the pulley 152 are also referably toothed.

The motion and the position of the stable platform 36 is sensed by a pair of rate transducers 156 and 158 which are mounted on the platform 36 on opposite sides of the cylinder 54 in which the azimuth shaft 52 is journaled. These transducers are preferably fluid rate sensors. They are solid state devices which monitor short term motions of the platform. One of these devices 156 has its fluid path parallel to the pitch axis while the other 158 has its fluid path parallel to the roll axis. The device 156 therefore functions as a pitch rate sensor while the device 158 functions as a roll rate sensor. Suitable devices may be of the type described in U.S. Pat. No. 3,500,691 issued Mar. 17, 1970 and may be procured from Humphreys, Inc., of San Diego, Calif. 92123. The long term motion of the platform 36 is detected by position or level sensors 160 which are mounted along an edge of the platform. One of these sensors senses the angular position of the platform 36 about the pitch axis while the other senses the angular position of the platform about the roll axis. These position sensors may be devices containing bodies of fluid partially filling tubes, one of which has its axis parallel to the pitch axis and the other of which has its axis parallel to the roll axis. Electrodes are provided in spaced positions on opposite sides of the bodies of fluid. The fluids act as a dielectric and change the capacitance presented between the electrodes as a function of the angular position of the fluid in the tube. Suitable position sensors may be procured from Spectron Glass and Electronics Co., Uniondale, N.Y., 11553. The outputs of the rate sensors 156 and 158 and of the position sensors 160 are used in a servo control system for providing control voltages to the pitch motor 142 and the roll motor 150 in order to maintain the platform stable. A suitable servo control system including the sensors 156, 158 and 160 and the motors 142 and 150 is described in detail in the above referenced patent application which is filled in the name of Joseph Graham Mobley. The system maintains the platform 36 stable entirely through the use of solid state devices and without the need for gyroscopic sensors or stabilizers which are generally unsuitable for use on board ship where vibrations oftentimes produce noise and saturate servo control systems. In maritime environments, a gyroscopically controlled or stabilized system may be inoperative to maintain a platform in stable position in spite of the pitching and rolling motion of the ship.

It is desirable that the weight of the antenna 64 be counter balanced so as to minimize the torque requirement of the elevation motor 112. Counter balancing weight is provided generally without the addition of any unnecessary weight by the diplexer 84 and a low noise amplifier 162 which are mounted on the plate 106 of the left side member 88. A power amplifier 164 (see FIG. 5) is mounted on the plate 108 of the right side member 90 and is connected to the diplexer 84 by means of a cable 165 which extends over the top of the box structure 86. The power amplifier 164, the diplexer 84 and the low noise amplifier 162 generally have sufficient weight to counter balance the antenna 64. Additional weights may be provided on the side arm as well as on the frame 34 and stable platform 36 for counter balancing purposes, as needed.

A cable 166 which carries electrical signals and power between the antenna 10 and other equipment of the satellite communications terminal which may be located below decks in the ship is provided with a cable wrap having sufficient slack so as to permit the antenna structure 18 to rotate both in azimuth and elevation by a desired degree of azimuth rotation and elevation travel, for example, over 270° of azimuth rotation and 90° of elevation travel. The cable 166 may be a multiconductor cable which extends upwardly through a central opening in the azimuth pulley 138 and azimuth shaft 52, and then through an opening 170 in the turntable 46. Appropriate connectors may be provided in the base at the foot of the post 20 for the cable 166, if desired. While the cable 166 is shown on the outside of the post 20, it may be preferable for the cable to be brought up through a central opening in the post 20 which may be tubular, from an opening in the side of the post at its foot where the connector may be located.

Suitable stops may be located on the turntable 46 to limit the travel of the antenna structure 18 in elevation. A strap 172 one end of which is connected to the cylinder 56 which is mounted on the platform 36 serves to limit the azimuth rotation of the turntable 46 and therefore of the antenna. Stops 174 and 176 mounted on brackets 178 and 179 which are secured to the arm 30 of the yoke (see FIG. 2) engage the frame 34 and serve to limit the movement of the frame 34 and platform 36 about the roll axis.

Figure 6:
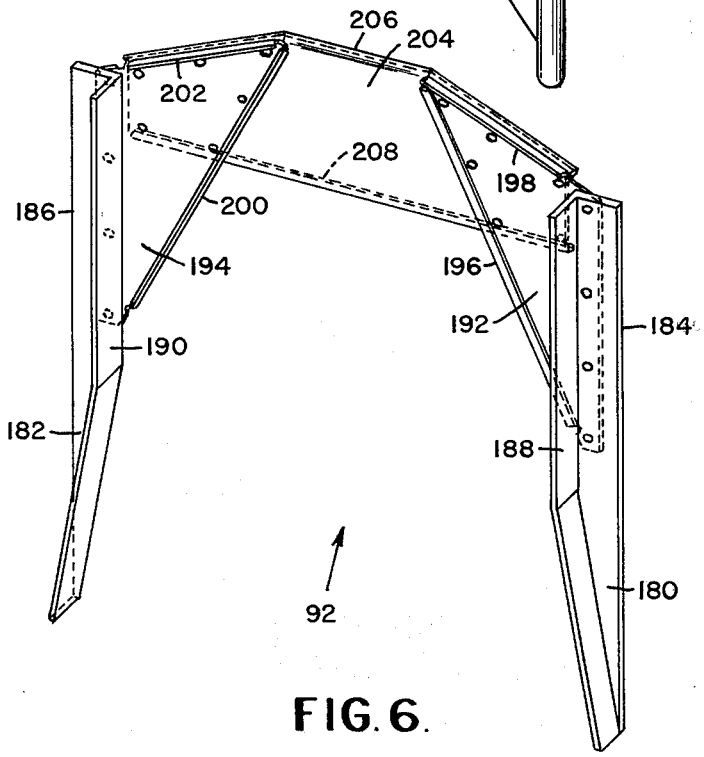
FIG. 6 is a perspective view of the arched beam structure in the antenna apparatus illustrated in FIGS. 1–5.
Figure 3:
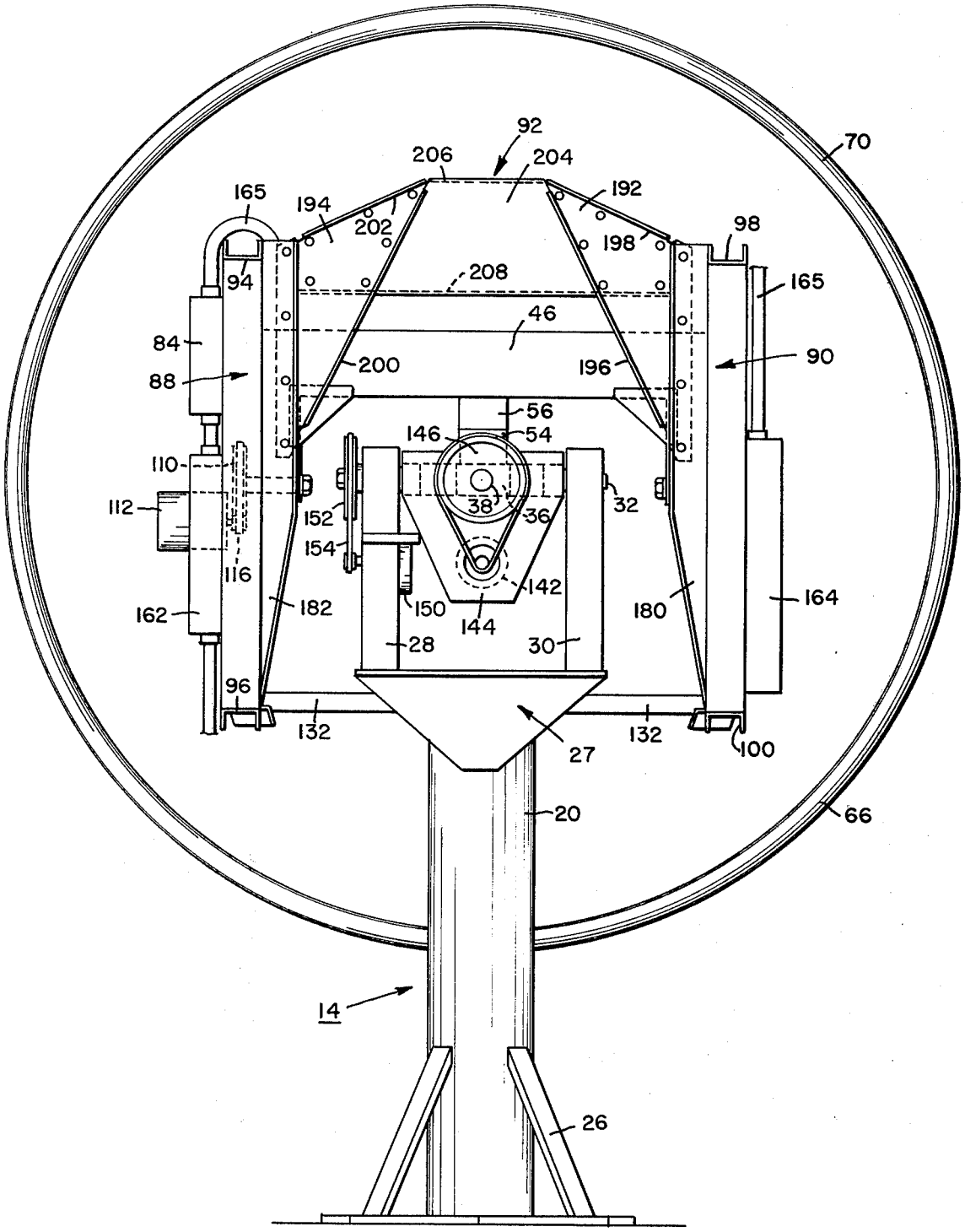
FIG. 3 is a rear view of the antenna apparatus illustrated in FIG. 1.
Figure 4:
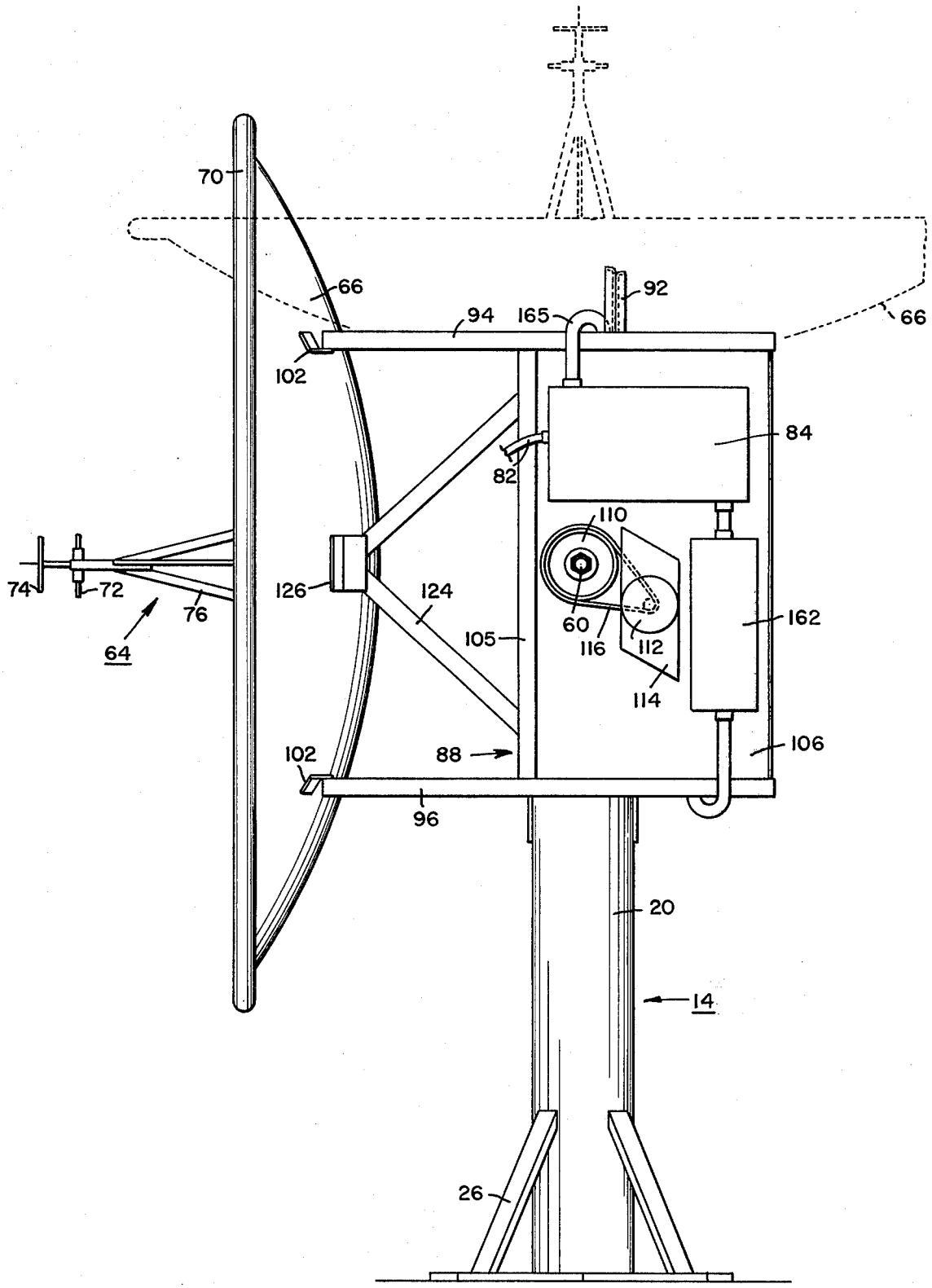
FIG. 4 is a view taken from the right side of the antenna apparatus illustrated in FIG. 1.
Figure 5:
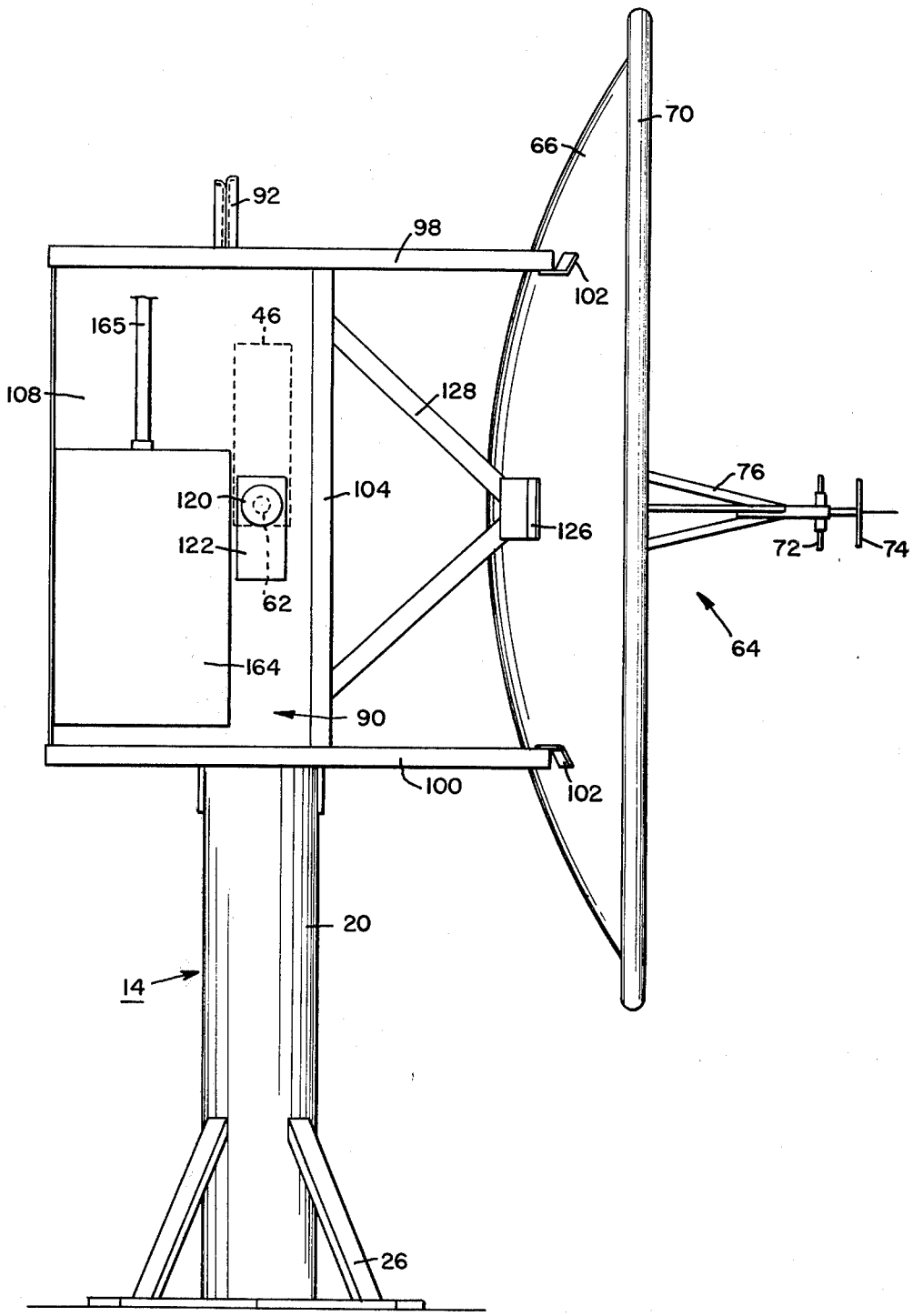
FIG. 5 is a view taken from the left side of the antenna apparatus as illustrated in FIG. 1.

The arched beam structure 92 is best shown in FIGS. 3 and 6. It consists of side legs 180 and 182 which are tapered at the lower end thereof. These side legs may be angle members which are welded along their outer edges 184 and 186 to the plates 106 and 108 of the left and right side members 88 and 90 respectively. The rear edges of the plates 106 and 108 may be bent outwardly to enclose the edges of the channels 94 and 96 in the case of the plate 106, and the channels 98 and 100 in the case of the plate 108. The angle formed by the bent rear end of the plates 106 and 108 serves to further strengthen the side members 88 and 90. The angles 180 and 182 have one of their sides 188 and 190 spaced inwardly from the side member such that the angles 180 and 182 and the side members 88 and 90 form channels for greater strength in the arched beam structure 92.

Extending inwardly from the angles 180 and 182 and secured thereto by rivets or nuts and bolts are triangularly shaped plates 192 and 194. The inner edges of the plates 192 and 194 are respectively formed with flanges 196, 198 and 200, 202. A bridge member 204 completes the arched beam structure 92. This bridge member 204 is a plate which has flanges 206 and 208 which extend in a direction opposite to the flanges 196, 198, 200 and 202 of the triangular plate 192 and 194. The bridging plate 204 is fastened to the triangular plates by rivets or by nuts and bolts. It will be observed from FIG. 1 and also from FIGS. 4 and 5 that the arched structure 92 is disposed immediately to the rear of the turntable 46. A large, clear area or space is thereby provided in the rear of the box structure 86 in which enables the antenna 64 and the entire box structure 86 to move bodily in elevation a full 90° (see FIG. 4). At the same time the arched beam structure affords a high degree of rigidity to the box structure and the entire antenna apparatus. In addition, the entire structure is provided from a minimum number of parts which are preferably made of aluminum or other light weight material. The box structure 86 together with its arch structure 92 is extremely strong and light in weight and therefore capable of being mounted at the top of the mast without imposing undue strain on the mast and yet being capable of being rotated in azimuth and elevation so as to be directed at and follow a satellite with respect to which communication is desired.

From the foregoing description it will be apparent that there has been provided an improved satellite tracking antenna apparatus. While a preferred embodiment of the apparatus has been described, it will be appreciated that variations and modifications therein within the scope of the invention will very likely present themselves to those skilled in the art. Accordingly, the foregoing description should be taken merely as illustrative and not in any limiting sense.

What is claimed is:

1. For use on a ship and the like, and adapted to be mounted at the top of the mast thereof, satellite tracking antenna apparatus which comprises a pedestal extending upwardly from said mast, a yoke on said pedestal, a platform, stabilized for pitch and roll motion of the ship, supported by said yoke, a turntable mounted on said platform, being rotatable in azimuth about an azimuth axis and defining an elevation axis perpendicular to said azimuth axis, a box shaped structure mounted on said turntable for rotation in elevation about said elevation axis, said satellite tracking antenna having a reflector, a pair of side members and said reflector being three adjacent sides of said box structure, said elevation axis intersecting said side members, said side members extending in a direction away from said reflector beyond said elevation axis and defining an open area within said structure beyond said turntable, unenclosed except for said side members, to permit rotation of said structure about said elevation axis over an angle of at least 90°, and an arched beam structure between said side members bracing said box structure without interference with said open area.

2. The invention as set forth in claim 1 wherein said box structure also has top brace members and bottom brace members extending between said side members and said reflector from positions located between said elevation axis and said reflector on said side members and positions on said reflector.

3. The invention as set forth in claim 2 wherein said top brace members are joined with said reflector and form an angle at the junction thereof, and said bottom brace members are also joined with said reflector to form an angle at the junction thereof.

4. The invention as set forth in claim 3 wherein said top and bottom brace members lie in the planes of the top and bottom of said box respectively.

5. The invention as set forth in claim 1 wherein said reflector is a dish and said box structure is disposed on the convex side of said dish, with said convex side forming a wall of said box structure.

6. The invention as set forth in claim 1 wherein said arched beam includes a top part and a pair of legs extending laterally downward from said top to form an inverted "U" shape, said legs each being attached to a different one of said side members and said top part bridging said side members and projecting above the top of said box structure.

7. The invention as set forth in claim 6 wherein said arched beam is located adjacent to the side of said turntable which faces away from said reflector.

8. The invention as set forth in claim 7 wherein said top part of said arched beam is plate, said legs each include a bracket member having a lateral edge attached to a side member and a triangular strut attached both to said bracket member and to said top part, said bracket member being substantially the same height as said side members.

9. The invention as set forth in claim 8 wherein said top part and said struts are overlapping over substantial portions thereof.

10. The invention as set forth in claim 9 wherein said struts and said top part are flanged along at least two lateral edges thereof, said flanges extending in opposite directions when said struts and top part are in assembled relationship forming said arched beam.

11. The invention as set forth in claim 1 wherein said side members are each formed of a plurality of arms, two of said arms extending longitudinally in parallel spaced relation from said reflector and being attached at one end thereof to said reflector, another of said arms extending laterally between said longitudinal arms at a position intermediate the ends thereof, and a rectangular plate mounted on said arms in the region defined by said lateral arm and the portions of said longitudinal arms which extend beyond said lateral arm in a direction from said reflector.

12. The invention as set forth in claim 11 wherein each of said side members also has a pair of braces defining a triangular strut, said braces being attached to said reflector at approximately the same point thereon and to said lateral arm at spaced points thereon.

13. The invention as set forth in claim 1 wherein said pedestal is a cylindrical post adapted to be mounted coaxially with said mast, and said yoke is a "U" shaped member having spaced legs and defining one of said pitch and roll axes about which said ship moves, said one axis being in substantially the same plane as said elevation axis when said post is vertical, said azimuth axis also being substantially coincident with the axis of said post when said post is vertical.

14. The invention as set forth in claim 13 wherein said turntable is a bar disposed above said platform, a shaft extending from said post to said platform and being rotatably mounted therein, the axis of said shaft being coincident with said aximuth axis, said turntable bar extending laterally on opposite sides of said shaft beyond said yoke, downwardly extending legs each on an opposite end of said turntable bar, and journals extending from said legs, said box structure being pivotally mounted on said journals, and the axis of said journals being along said elevation axis.

* * * * *